US006025414A

United States Patent [19]

Rich

[11] Patent Number: 6,025,414

[45] Date of Patent: Feb. 15, 2000

[54] HEAT MOLDABLE COMPOSITION

[75] Inventor: Jeffrey S. Rich, New York, N.Y.

[73] Assignee: Jeffery S. Rich, New York, N.Y.

[21] Appl. No.: 09/090,716

[22] Filed: Jun. 4, 1998

Related U.S. Application Data

[63] Continuation-in-part of application No. 08/808,719, Feb. 28, 1997, abandoned.

[51] Int. Cl.[7] ..... C09G 1/00; C08L 57/02

[52] U.S. Cl. ..... 523/167; 524/500; 524/502

[58] Field of Search ..... 524/500, 502; 523/167

[56] References Cited

U.S. PATENT DOCUMENTS 4,990,556 2/1991 Shimizu et al. ..... 524/475

*Primary Examiner*—Kriellion Sanders
*Attorney, Agent, or Firm*—Mayer, Brown & Platt

[57] ABSTRACT

The present invention is directed to a novel heat moldable composition and the process for making said composition. The inventive composition comprises a blend of gelling agents, such as thermoplastic polymers, resiliency components, such as styrene-butadiene or styrene-isoprene copolymer and softening agents, such as oils.

25 Claims, No Drawings

HEAT MOLDABLE COMPOSITION

This application is a continuation-in-part of application Ser. No. 08/808,719, filed on Feb. 28, 1997 now abandoned.

BACKGROUND OF THE INVENTION

The present invention is directed to a novel heat moldable composition, the process for making said composition and utilitarian devices made of said composition. The inventive composition comprises a blend of (i) gelling agents, such as thermoplastic polymers, (ii) resiliency components, such as styrene-butadiene copolymers, styrene-isoprene copolymers or other resilient amphorous polymers and (iii) softening agents, such as oils. Depending upon the relative proportions of the three aforementioned ingredients, the texture of the inventive composition can range from soft and gel-like to hard and rubbery. Further, the proportions can be adjusted so as to offer, to varying degrees, shock absorbing and support properties, said support properties being directly related to the compressive strength of the composition.

There is a multitude of products which are designed to conform to individual body parts. Examples of these products include chair seats, shoes and pillows, sporting equipment such as helmets, boots, and protective gear, and products for medical uses such as casts, braces and orthotics.

The purpose of these products is generally to provide the benefits of comfort, support, protection and shock absorption to the user. These products can be generic or, more preferably, can be customized to fit a particular individual's body part. With respect to customizable products, most can be fitted once, are not remoldable, and are usually very expensive.

In an effort to provide a low cost custom fitting athletic shoe, Reebok has introduced the Pump™. The Pump™ offers a customized fit by utilizing air bladders in conjunction with an air pump. The air bladders are deposed at selected locations on the interior of the shoe. The wearer can then activate the pump thereby filling the bladders with pressurized air. This inflation allows the shoe to better conform to the shape of the wearer's foot. However, the drawback of this design is that the air bladders need to be inflated before and/or during each use. Further, this design does not offer significant shock absorption or protection.

Other athletic shoes on the market contain inserts of air or gel at various selected locations on the interior of the shoe so as to provide support and/or shock absorption. However, these inserts do not provide a customized fit. Additionally, in the case of the air inserts, the air tends to move from side to side during use, thereby reducing its motion control and effectiveness. Also, all of these products tend to wear out over time and become less effective.

The Raichle Company of Switzerland has introduced an ethylvinyl acetate remoldable innerboot under the name ThermoFlex™. While ThermoFlex™ is an improvement from the products of the past, it possesses a number of drawbacks. ThermoFlex™ offers limited shock absorption; it is too soft for heavier or advanced skiers; the temperature at which it must be molded, 120° C., is too hot to be allowed to come into direct contact with the individuals skin whose body temperature is 37° C.; it is not reusable more than five times; it is difficult to fit and therefore must be applied by a professional.

Unlike the above-described products, the composition of the present invention is firm enough to offer support and shock-absorption, while maintaining enough flexibility to allow comfortable use through conformation to the user's body part. Additionally, unlike other molded products, the compositions of the present invention do not compress or degrade over time.

The present invention is especially suitable for use in ski boots and in-line skate boots. In these instances, a custom fit is particularly important but has been very difficult to achieve. In an effort to achieve a custom fit, foams, silicone foams and silicones have been used for more than twenty years with mixed success. They are generally expensive, difficult to use and may generate hazardous fumes. These products must be fitted by a professional sales person and can only be fitted once. Additionally, since these products are not remoldable and can not be reused, if an error is made in the fitting process, the product must be discarded and the process restarted. Also, most of the currently available products eventually break down and soften after a few months of use.

All documents which are cited in this disclosure are hereby incorporated by reference.

OBJECT OF THE PRESENT INVENTION

Accordingly, it is an object of the current invention to provide a moldable composition that is reusable when heated to a relatively low temperature by a conventional method, sets up quickly at room temperature and can be made to conform to any body part.

Various other objects, advantages and features of the present invention will become readily apparent from the ensuing detailed description, and the novel features will be particularly pointed out in the appended claims.

SUMMARY OF THE INVENTION

This invention is directed to a novel heat moldable polymeric composition comprising a blend of a gelling agent, such as a thermoplastic polymer, a resiliency component, such as styrene-butadiene copolymer, styrene-isoprene copolymer or other resilient amphorous polymer and a softening agent, such as oils.

A resiliency component is that component which imparts bounce, rubber-like, resilient characteristics to the final product or composition.

A softening component controls the flowability (malleability) of the final composition. In the heated state, the softening components makes the final composition more malleable. Preferable softening agents include oils.

A gelling agent is that component which imparts rigidity or stiffness to the final composition. Preferable thermoplastic polymers include biodegradable polymers, for example, poly (epsilon-caprolactone), also known as polycaprolactone.

Additives such as glycerine monostearate may also be used as a substitute for or in addition to the thermoplastic polymers.

In accordance with the uses of the present invention, an athletic shoe can be equipped with customized inserts which contain the inventive composition. These inserts can be placed at the tongue of the shoe, at the heel and/or upon all or some of the length of the insole. An insole containing the inventive composition would be firm enough to provide customized support at the arch and heel, thereby helping to prevent pronation caused by knee injuries, yet soft enough to absorb much of the shock and strain associated with running or other sports.

Another useful application of the inventive composition is in the medical field for custom-shaped articles, such as inserts for limb braces and the like. Limb brace inserts normally need to be regularly recasted to account for changes in the patient's condition, such as swelling.

The inventive composition may be sold in sheet form with fabric and/or foam backing. It is also contemplated that colors and/or scents can be added to the inventive compositions to achieve desired effects.

DESCRIPTION OF THE PREFERRED EMBODIMENTS

The chemical and mechanical properties of the compositions of the present invention are such that the composition may be shaped as desired and used as a protective, orthotic device or support device in a multitude of applications. Fields in which the device may be utilized are, for example, the medical and sporting goods fields.

The composition becomes firm at approximately 60° C., and, depending upon the relative proportions of ingredients used, can form either a soft gel-like material or a firm rubber-like material, yet it will retain its shape through the full range of temperatures below its melting/molding point. Between 50° C. to 60° C., the composition begins to set up and under 50° C., the composition is no longer malleable. However, once heated, the composition becomes malleable by hand and may be conformed to virtually any shape desired.

Upon setting up at room temperature, the composition will retain its consistency as well as the shape it was given in the molding process. The composition, once set-up, has shock absorption properties and may be used as such. The pieces can be customized to fit in athletic shoes, dress shoes, bicycle seats, knee braces, ankle braces, wrist braces, back braces, limb braces, sports helmets, ski boots, ice skates, in-line skates, wheelchairs, automobile seats and even eating utensils, arts and crafts, caulking compounds, toys and the like. Also, the composition may be customized for use in the dental field to create molds for dental implants, retainer, bite plates, teeth molding and like. The composition is remoldable and reusable an infinite number of times. For example, this advantageously permits the braces to be recasted to accommodate changes in patient's condition, such as swelling. By incorporating an environmentally safe thermoplastic polymer, the composition itself is environmentally safe. The composition may be incorporated into products during the manufacturing process or as separate inserts to be used with existing stock products.

The inventive composition comprises blends of gelling agents, resiliency components and softening agents.

The gelling agents provide rigidity to the composition. Suitable gelling agents are thermoplastic polymers. Preferably, the thermoplastic polymer is environmentally safe and can be heated by microwave.

In a preferred embodiment of the present invention, the thermoplastic polymer is polycaprolactone. The melting point of polycaprolactone is 60° C. The density at 23° C. is 1.145 g/cc. U.S. Pat. No. 3,867,324 discloses novel polymeric blends incorporating biodegradable thermoplastic polymers such as poly (epsilon-caprolactone) or the like, useful in the present invention.

Other suitable gelling agents may include, but are not limited to, polyethylene, polypropylene, polybutene-1, poly (tetramethylene oxide), and poly(oxypropylene). Block copolymers such as poly(styrene-b-butadiene), and poly (styrene-b-isoprene) may also be used.

Preferably, the resiliency component has a high molecular weight, greater than 500,000, a solubility parameter similar to styrene-butadiene or styrene-isoprene copolymer, a low glass point, and a low melting point. Suitable resiliency components may include, but are not limited to, polyethylene (branched), polyisobutylene, poly(isobutylacrylate), poly(butylacrylate) poly(butylmethacrylate), poly (isobutylmethacrylate) poly(1,4 cis butadiene), poly (chloroprene), poly(tetramethylene oxide) or amorphous copolymers such as polypropylene (EPR rubber) poly (chlorotrifluoroethylene-co-vinyline chloride), poly (styrene-co-butadiene), and poly(ethylene-co-vinylacetate).

Preferably, the solubility parameters of the softening agents should be near that of the resiliency agent and boiling points above 200° C. Additionally, suitable softening agents are non-toxic, have no smell and provide for a final product with little tack. In accordance with a preferred embodiment, the softening agent is mineral oil. Suitable softening agents may include, but are not limited to, dodecane, diamylphthalate, dibutylsebacate, diisodecylphthalate, dioctyladipate, dioctyl phthalate, dioctylsebacate, ethylbenzoate, tricresyl phosphate, turpentine, pine oil, propyl butyrate, Solvesso 150 and terpene.

Each ingredient contributes a different characteristic to the final product. For example, when a higher proportion of thermoplastic polymer is utilized, the end product will be harder. When a higher proportion of softening agent is utilized, the final product will be more malleable or gel-like. When the proportion of resiliency component is increased, the final material will be more flexible. A drawback of increasing the amount of resiliency component is that the molding temperature will be higher. Glycerine monostearate can be substituted for plastic, however, too much glycerine monostearate results in a product that is too soft and molds at room temperature. It is appreciated that a person of ordinary skill in the art can adjust the ratio of ingredients to attain a composition with the desired qualities.

Additives such as glycerine monostearate may also be used as a substitute for or in addition to the thermoplastic polymers. The compositions made from the blends can range from a soft gel-like material to a hard, rubbery plastic. Throughout this range, the compositions are able to absorb shock and provide support. The compositions have melting points and molding temperatures sufficiently low that they may be heated in a conventional manner such as in a microwave or convection oven, or with a heat gun. Microwave ovens are particularly useful for heating and softening the composition for fitting, because it can be accomplished generally without boiling water, though boiling water can be used. A conventional oven may also be used. Additionally, wire filaments may be placed into the inventive composition. When an electrical current is applied to the wire filaments the resulting heat will soften the composition. The inventive composition can be refitted and reused by simply reheating.

Skin burns during the molding process are avoided because of the low molding temperature of the inventive composition. Further, the composition's low molding temperature allows the insert to be held against the desired body part. A sock lining can also be used to further protect sensitive areas from excess heat. The composition may then be molded to the desired shape, such as to conform to a body part, and then set upped quickly at room temperature. Once the composition is heated, the user has approximately 2 to 3 minutes to mold and/or shape it.

Shaping and/molding of the composition is easily accomplished. Pockets or pieces containing the heated composition can be inserted in or attached to any item with which it will be used. The user can then wear, sit-on or put-on the item and conform the composition to the given body part. The composition completely sets up in about five to ten minutes depending on the volume of the composition and is ready for use. It is appreciated that the term "sets up" defines a non-chemical transition from a pliable material to a rigid material.

It is appreciated that fillers, such as hollow spheres, may be added to the composition without significantly affecting the above-noted characteristics of the composition. This advantageously permits the volume of the composition to be increased without significantly increasing the weight of the composition. The volume of the composition may be increased by 25% with the fillers without significantly affecting the above-noted characteristics of the composition. Suitable filler material may include, but is not limited to, glass beads, microballoons, glass bubbles, cork, phenolic balloons and 3M Scotchlite Glass Bubbles It is also appreciated that the composition may be sold in sheet form with fabric and/or foam backings. The composition may be sandwiched between two fabric backings, two foam backings or one foam backing and one fabric backing. This advantageously prevents the composition from coming into direct contact with the user and leaving residue of the composition on the user. Additionally, the absorption properties of the fabric and/or foam backings may absorb any sweats generated by a user, thereby increasing the effective life span of the composition or the utilitarian device made with the composition. Further, the fabric and/or foam backings advantageously permit the user to more easily slip-on or slip-off the utilitarian device made with the composition, i.e., braces, formed boots, etc.

It is also contemplated that colors and/or scents can be added to the inventive compositions to achieve desired effects.

EXAMPLES

The processes for manufacturing the compositions of the present invention generally include mixing the ingredients under sufficient heat to melt the ingredients and then heating the mixture while stirring until a homogeneous mixture is achieved. A person of ordinary skill can adjust the parameters of the process depending on the size of the batch and the relative proportions of each ingredient. All ingredients are to be thoroughly blended in order to provide the desired final product.

The following examples are illustrative of some of the products and methods of making the inventive compositions. Such examples are not to be considered in any way limiting. Numerous changes and modifications can be made with respect to the invention and will be obvious to one skilled in the art.

Example 1

Approximately 50 grams of styrene isoprene block copolymer (15% polystyrene and 85% polyisoprene), 50 grams of mineral oil and 50 grams of the thermoplastic polymer, polycaprolactone, are added together in a aluminum vessel and placed in a preheated 176.7° C. (or 350° F.) oven. The mixture will begin to melt in approximately 10 minutes. The vessel is then removed from the oven and placed on an insulated board whereupon the mixture is stirred vigorously for about 30 seconds. The vessel is then put back in the oven. Over approximately the next 30 minutes the vessel is removed for stirring for one minute every five minutes. Care should be taken to prevent charring of the sample. After about 30 minutes from the start, the styrene-butadiene copolymer begins to soften and becomes translucent. At this point, the stirring should be extremely vigorous to ensure thorough blending of the ingredients and to accelerate the absorption of the liquid components by the resiliency component. After about 120 minutes in the oven and vigorous stirring, the ingredients will be completely melted. The oven temperature is to be reduced to 160° C. and the heating/stirring continued until all components begin to set up as to form a cloudy, smooth viscous mixture, after which time the vessel is allowed to cool at room temperature. After cooling for approximately 5 to 10 minutes, the mixture sets up to form an opaque, gel-like solid. Alternately, the composition may be poured into a mold for shipping or later use.

Other proportions of ingredients which can be utilized in accordance with Example 1 are as follows:

TABLE 1

| MIXTURE | STYRENE BUTADIENE Copolymer (Grams) | MINERAL OIL (Grams) | GLYCERINE MONOSTEARATE (Grams) | THERMOPLASTIC POLYMERS (Grams) |
|---|---|---|---|---|
| 1 | 40 | 40 | 0 | 40 |
| 2 | 40 | 80 | 0 | 40 |
| 3 | 40 | 40 | 0 | 20 |
| 4 | 40 | 40 | 0 | 60 |
| 5 | 40 | 40 | 0 | 80 |
| 6 | 40 | 40 | 0 | 100 |
| 7 | 40 | 40 | 0 | 120 |
| 8 | 40 | 40 | 0 | 140 |
| 9 | 40 | 40 | 40 | 0 |
| 9 | 40 | 80 | 40 | 0 |
| 10 | 40 | 40 | 20 | 0 |

The relative hardness of the final cooled mixtures of the above examples were measured using a durometer Type 00 (ASTM D2240) and the following results were obtained:

TABLE 2

| MIXTURE* | DUROMETER MEASUREMENT |
|---|---|
| 1 | 60 |
| 2 | 31 |
| 3 | 55 |
| 4 | 16 |
| 5 | 75 |

The relative hardness of the final cooled mixtures of the previous example were measured using a durometer Type A (ASTM D2240) and the following results were obtained:

TABLE 3

| MIXTURE* | DUROMETER MEASUREMENT |
|---|---|
| 4 | 16 |
| 5 | 20 |
| 6 | 25 |
| 7 | 30 |
| 8 | 35 |

*The mixture numbers correspond to the mixtures delineated in Table 1.

Example 2

The heat moldable composition of Example 1, containing 50 grams of styrene isoprene block copolymer (15% polystrene and 85% polyisoprene), 50 grams of mineral oil and 50 grams of polycaprolactone is made into a form fitting shoe insert. The composition is placed into a microwave oven at room temperature and heated to approximately 60° to 85° C. thereby softening the composition significantly. While still soft, a portion of the composition is pressed against the bottom of the user's foot so as to leave an imprint in the composition. The edges of the molded product are trimmed to size and the resultant sole insert can then be placed into the user's shoe. The result is a shoe-insert that provides both support and shock absorbing properties.

Example 3

A second portion of the composition of Example 2 is heated in a microwave oven for 2 to 4 minutes. The resultant composition is again easily manipulated once it has been substantially softened.

The polymer composition is molded around the entire foot, ankle and lower calf portion of an individual to form a boot-like shape. The composition is allowed to cool in this position. The thus-formed "boot" is removed from the foot and inserted into the plastic shell of a ski boot. The resulting ski boot has an inner shock-absorbing insert that custom fits the individual.

The formed boot can be subsequently removed, reheated and reformed for a second individual. The reformed custom fitting boot can again be inserted into a ski boot to result in a custom fit for a second individual. The innerboot can be heated together with the ski boot shell or heated separately from the ski boot shell.

It is understood that while the invention has been described in conjunction with the preferred embodiments thereof, that the foregoing description is intended to illustrate and not limit the scope of the hereto appended claims. Various changes or modifications, which may be made without departing from the spirit or scope of the invention, may be obvious to those skilled in the art.

What is claimed is:

1. A heat moldable composition having a defined shape which may be changed by reheating comprising:

a gelling agent for imparting rigidity to said composition and which may be softened with the application of heat;

a resiliency component for imparting rubber-like resilient characteristics to said composition; and a softening agent for controlling flowablility of said composition; and wherein said composition has an optimal hardness greater than 16 on a Type "O" scale durometer and less than 45 on a Type "A" scale durometer and can be softened to a moldable hardness of less than 2 by heating at 60° C. for a period of greater than 3 minutes and less than 10 minutes.

2. The reusable heat moldable composition of claim 1, comprising 33.3% by weight of a gelling agent, 33.3% by weight of a resiliency component and 33.3% by weight of a softening agent.

3. The reusable heat moldable composition of claim 1, wherein the gelling agent is a thermoplastic polymer.

4. The reusable heat moldable composition of claim 3, wherein the thermoplastic polymer is polycaprolactone.

5. The heat moldable composition of claim 1, wherein the resiliency component is styrene-butadiene copolymer.

6. The heat moldable composition of claim 1, wherein said softening agent is oil.

7. A process for making a reusable heat moldable composition, comprising the steps of:

combining a gelling agent with a resiliency component and a softening agent to form a composition, said gelling agent imparting rigidity to said composition, said resiliency component imparting a rubber-like, resilient characteristic to said composition and said softening agent controlling flowability of said composition;

heating said composition to boiling to provide a boiling composition;

alternately heating and stirring said boiling composition until said resiliency component melts; and continuing to heat and stir said composition until all components "set up" to form a cloudy, smooth viscous mixture.

8. A utilitarian device made from the composition of claim 1.

9. A utilitarian device of claim 8, wherein said device is an insert for a boot.

10. A utilitarian device of claim 8, wherein said device is an insert for a shoe.

11. A utilitarian device of claim 8, wherein said device is an insert for a prosthesis.

12. A utilitarian device of claim 8, wherein said device is an insert for a knee brace.

13. A utilitarian device of claim 8, wherein said device is an insert for a helmet.

14. A utilitarian device of claim 8, wherein said device is an insert for a boxing glove.

15. A utilitarian device of claim 8, wherein said device is an insert for an ankle brace.

16. A utilitarian device of claim 8, wherein said device is an insert for a back brace.

17. A utilitarian device of claim 8, wherein said device is an insert for a car seat.

18. A utilitarian device of claim 8, wherein said device is an insert for an office chair.

19. A utilitarian device of claim 8, wherein said device is an insert for a bicycle seat.

20. A utilitarian device of claim 8, wherein said device is an insert for a wheelchair.

21. A utilitarian device of claim 8, wherein said device is a toy.

22. A utilitarian device of claim 8, wherein said device is arts and crafts.

23. A utilitarian device of claim 8, wherein said device is molds for dental implants.

24. A heat moldable composition having a defined shape, which may be reshaped by heating, the composition comprising:

a gelling agent holding a shape, the gelling agent being made malleable by heating; and a rubberlike resiliency component; and a softening agent allowing flowablility of said composition; and wherein said composition has an optimal hardness greater than 16 on a Type "O" scale durometer and less than 45 on a Type "A" scale durometer and can be softened to a moldable hardness of less than 2 by heating at 60° C. for a period of greater than 3 minutes and less than 10 minutes.

25. A process for making a heat moldable object whose shape may be changed by reheating, the process comprising the steps of:

creating an object by combining a gelling agent with a resiliency component and a softening agent, wherein the gelling agent imparts rigidity, the resiliency components imparts a rubber-like, reslient characteristic and the softening agent controls flowability;

heating and stirring the object until the resiliency component melts; and shaping the object in a predetermined shape.

* * * * *